United States Patent [19]

Edling

[11] Patent Number: 4,836,761

[45] Date of Patent: Jun. 6, 1989

[54] ROTARY ENGINE WITH A PAIR OF PISTON ASSEMBLIES AND SHUTTLE VALVES

[76] Inventor: Jack V. Edling, 2116 Camino Dr., Escondido, Calif. 92026

[21] Appl. No.: 104,401

[22] Filed: Oct. 5, 1987

[51] Int. Cl.[4] ..... F01C 11/00

[52] U.S. Cl. ..... 418/188; 418/211; 418/214; 418/232

[58] Field of Search ..... 418/188, 211, 214, 217, 418/228–231, 249, 232

[56] References Cited

U.S. PATENT DOCUMENTS

| | | | |
|---|---|---|---|
| 605,564 | 6/1898 | Galpin | 418/211 |
| 777,417 | 12/1904 | Higgins | 418/211 |
| 1,177,380 | 3/1916 | Carpenter | 418/211 |
| 1,184,114 | 5/1916 | Matthews | 418/211 |
| 2,498,971 | 2/1950 | Warner et al. | 418/230 |

FOREIGN PATENT DOCUMENTS

| | | | |
|---|---|---|---|
| 944190 | 6/1956 | Fed. Rep. of Germany | 418/188 |

*Primary Examiner*—John J. Vrablik

*Attorney, Agent, or Firm*—Frank D. Gilliam

[57] ABSTRACT

A steam engine of the rotary type including a housing with two annular chambers with each chamber having a piston assembly operable therein. The piston assemblies are carried by a common shaft and displaced 90 degrees apart. Each piston assembly includes two pistons. The pistons have their working end surfaces 180 degrees of rotation apart. The rotor shaft is hollow along a portion of its length. The hollow portion of the shaft delivers fluid under pressure from an external source through channels within the pistons to fluid troughs in the circumferential surfaces of the annular chambers. Additional channels in the annular chambers and housing provide fluid under pressure to actuate shuttle valves at specific rotation locations of the pistons in each chamber. Each chamber includes side wall vents for exhausting spent working fluid. A screen is positioned vertically between the adjacent vents to cause condensate to be directed to a collection sump by gravity.

12 Claims, 4 Drawing Sheets

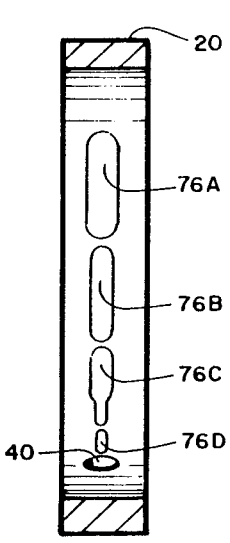
FIGURE 10
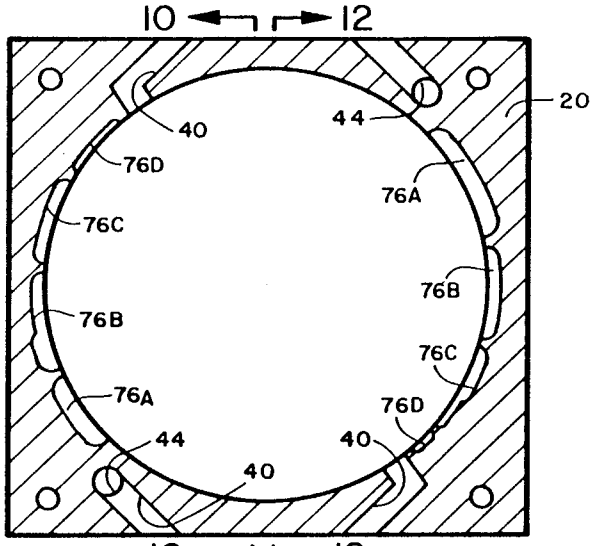
FIGURE 11
FIGURE 12
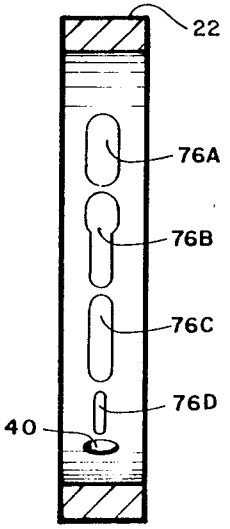
FIGURE 13
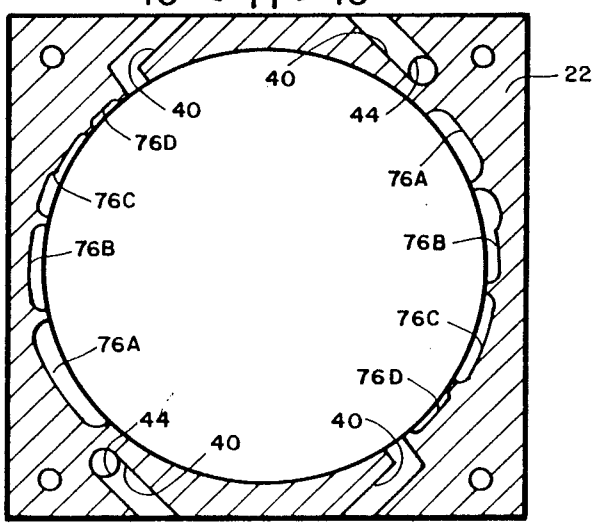
FIGURE 14
FIGURE 15

ROTARY ENGINE WITH A PAIR OF PISTON ASSEMBLIES AND SHUTTLE VALVES

BACKGROUND OF THE INVENTION

The invention relates generally to external combustion engines and more particularly to a rotary fluid pressure engine having only three moving parts and these moving parts are normally operated only by working fluid under pressure.

Prior art relating to external combustion engines of the rotary type generally operated by compressed air, steam or other working fluids under pressure, are of two general types. One type employs pistons of various shapes rotating in annular chambers with various mechanical means used to divide the chambers into compartments, while other mechanical means inject fluid under pressure into the various compartments. The prior art types are all characterized by levers, gears, rotating disks, springs, cam operated valves, gates, rollers, belts, pulleys and various other mechanical methods and devices to cause the fluid under pressure to exert pressure on the working surface of a piston during its power cycle.

A second type of rotary external combustion engine of the prior art employs one or more eccentric rotors with a reciprocating stator in annular chambers utilizing various mechanical elements such as rods, cranks, worm or helical gears to introduce operating fluid into the chamber between the rotor and the stator. Exhaust ports are located within an annular chamber forward of the eccentric rotor contact point with the annular chamber.

Typical examples of the prior art directed to the above noted types of rotary external combustion engines can be found in the following U.S. Pat. Nos. 605,564; 614,107; 669,447; 723,242; 777,417; 1,158,325; 1,293,459; and 3,739,754.

SUMMARY OF THE INVENTION

This invention is directed to a novel external combustion rotary engine having pairs of adjacent vertically positioned chambers with each of the annular chambers housing a piston assembly which includes two pistons. The pistons of each assembly are rotatably positioned 180 degrees apart. Top, bottom, sides and end plates enclose the chambers. A bottom opening, between the annular chambers provides a drain for spent working fluid for collection in a central sump for reuse. A pair of shuttle valves translate between the chambers by action of the pressured working fluid when the pistons in each chamber are located at valve actuation positions. Both of the shuttle valves operate simultaneously in the same direction of translation.

The piston assemblies are carried by a central shaft which has a power output connection at one end. A portion of the shaft is hollow to provide a communication path between the source of working fluid under pressure and the chambers. A channel extends from the hollow portion of the shaft to the exterior surface of each of the pistons at a location opposite the central annular surface of the chamber. The central annular surface of the chambers have a plurality of fluid troughs each adjacent trough having a declining area in the direction of piston travel. The troughs of each opposing annular chamber surface positioned 180° apart around the chamber inner surface are sized so that the troughs directly opposing have unequal lengths so that the working fluid will always be acting on at least one of the pistons of each assembly when working fluid under pressure is present within the hollow portion of the shaft.

The surface of each piston which is adjacent to the exhaust port is tapered from the working surface toward the leading edge forming a cam surface therealong. In the event that the working fluid is terminated at the hollow portion of the shaft this cam surface engages a shuttle valve outer surface translating the valve out of the way of the piston and into the opposite chambers. It should be understood that there is no mechanical contact between the piston and the valves when working fluid is present within the hollow portion of the shaft.

The channel between the hollow portion of the shaft and the external surface of the pistons terminates in a port at the outer surface of the piston at a location adjacent the central trough portion of the annular chamber near the working surface of the pistons. A pair of opposed second channels extend from the central portion of each chamber to one side of the translatable valves. When the opening in the piston from the channel leading from the hollow portion of the shaft is introduced to the second channel in the central portion of the chamber, working fluid is introduced into one side of the shuttle valves and when the piston in the opposite chamber rotates past a valve interference position the valves translate into the opposite chamber. The valve is held in its last translated position by fluid pressure in the channel blocked by the opposite rotor. There is no mechanical connection during normal operation for valve actuation.

This shuttle valve translation from annular chamber to annular chamber repeats every 180 degrees of each piston assembly rotation.

An exhaust port is located in the inner side wall of each chamber, and opens into an exhaust manifold therebetween. The exhaust ports of each chamber have an opposed adjacent relationship as do the tapered piston surfaces. A vertically positioned sheet preferably of porous or screen material is positioned in the exhaust chamber between the vent openings. The porous material causes spent working fluid when in the form of a liquid to condensate and be directed toward the bottom of the housing by gravity through an opening therein to an insulated collection sump for reuse.

The heated walls of the exhaust manifold and insulated sump provide a degree of thermal containment whereby when the working fluid is steam and the condensate resulting from spent steam is maintained at an elevated temperature which results in requiring a minimum amount of energy to change the condensate back to steam. Additional insulation material well known in the insulation art is added to increase the efficiency of the engine of the invention.

The present invention is more efficient than existing steam engines for three reasons. First, the small amount of steam injected into each rotor on each cycle expends a higher proportion of its energy in the contained chamber of the rotor before it is exhausted than in existing designs. Second, the engine is completely insulated so that the hot condensate which flows down the center exhaust manifold is collected in an insulated sump and then pumped back to the heat source with small heat loss. This results in a more efficient engine since the efficiency of an engine is largely dependent upon the ratio of the heat utilized to the heat lost. Third, with fewer moving components and the smaller and lighter reciprocating shuttle valves instead of larger and heavier reciprocating pistons there is both less internal friction and less inertia to overcome.

The principal object of this invention is to provide a highly efficient external combustion rotary engine.

Another object of the invention is to provide a substantially trouble free rotary external combustion engine.

A further object of the invention is to provide a rotary external combustion engine that has a minimum of moving parts and those moving parts are moved by the working fluid and not by mechanical means.

Still a further object of the invention is to provide an improved rotary seal means to prevent escape of the working fluid from the housing.

These and other objects and advantages of the invention will appear more clearly from the following specifications in connection with the accompanying drawings, in which:

BRIEF DESCRIPTION OF THE DRAWING FIGURES

FIG. 10 is a showing taken along line 10—10 of FIG. 11;

FIG. 11 is a showing taken along line 5—5 of FIG. 3 with the piston removed;

FIG. 12 is a showing taken along line 12—12 of FIG. 11;

FIG. 13 is a showing taken along line 13—13 of FIG. 14;

FIG. 14 is a showing taken along line 6—6 of FIG. 3 with the piston removed; and FIG. 15 is a showing taken along line 15—15 of FIG. 14.

DETAILED DESCRIPTION OF THE PREFERRED EMBODIMENT

Figure 1:
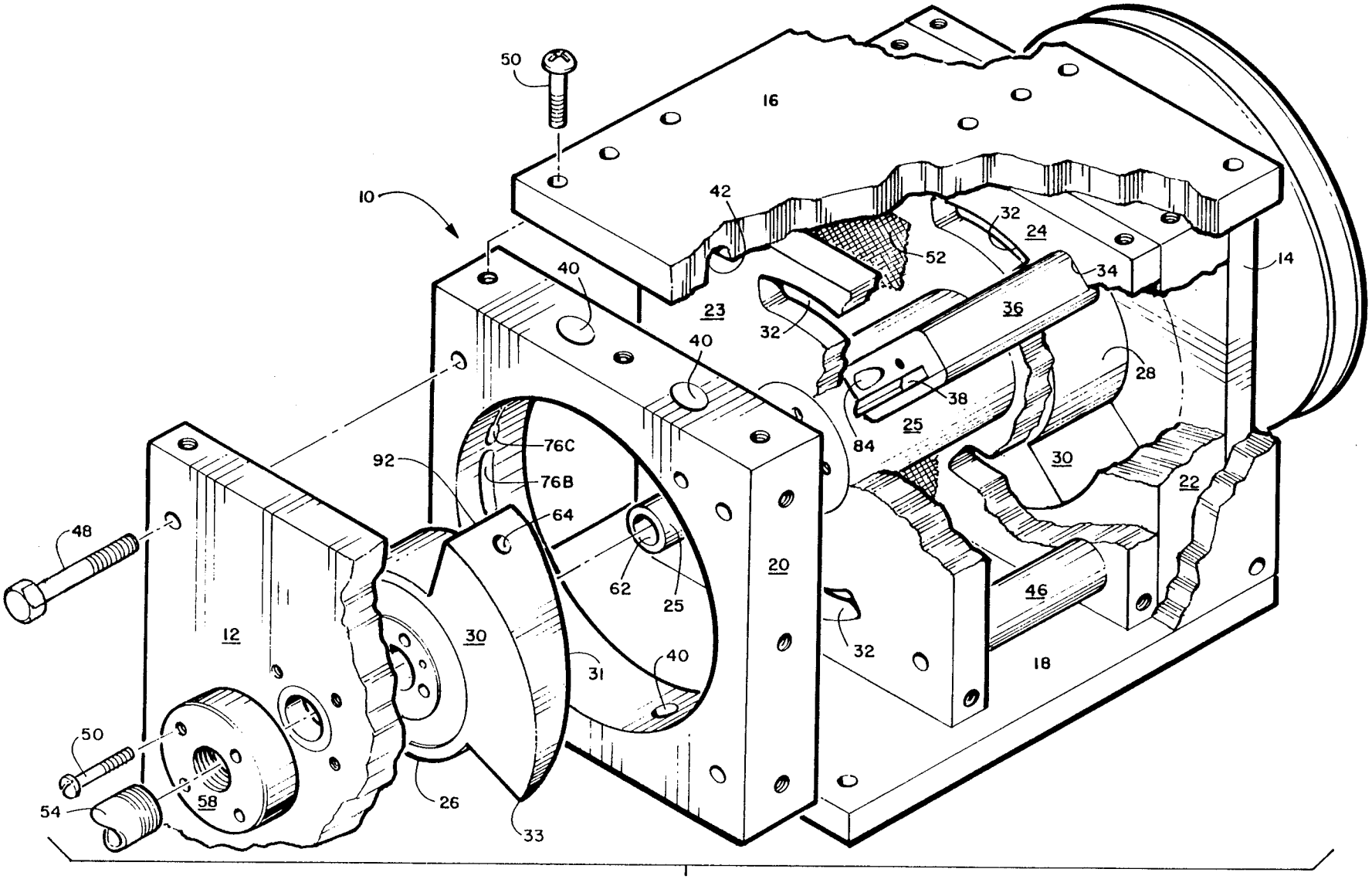
FIG. 1 is an exploded partial cutaway showing details of the invention.

Referring now to the various drawing Figures. FIG. 1 depicts a partial cutaway showing of the rotary external combustion engine 10 of the present invention. The engine housing includes a working fluid input end plate 12, an output end plate 14, a bottom or floor surface 18, side walls 17 ( see the various other figures) and a cover or top surface 16.

Within the housing is a pair of annular chambers 20 and 22. The inside surfaces of the annular chambers are enclosed by mirror image annular chamber end plates 23 and 24. A partially tubular or hollow rotor shaft 25 passes through the engine 10 longitudinally. The shaft is rotatably supported on the ends by the end plates 12 and 14 and passes through the chamber inner end plates 23 and 24 without contact therewith. The shaft has a pair of piston assemblies 26 and 28 fixedly attached thereto. The piston assemblies are positioned one within each chamber when the shaft is in operational position.

Each of the piston assemblies includes a pair of pistons 30. The surface 31 of each piston adjacent to the exhaust port 32 is tapered at an angle of approximately 30 degrees from a working surface 92 toward a leading edge 33 forming a cam surface therealong (see FIG. 1 for a typical piston configuration). The pistons of each piston assembly are positioned 180 degrees apart. The piston assemblies are displaced 90 degrees apart, i.e. the pistons of the piston assembly 26 are positioned in quadrants 1 and 3 and the pistons of piston assembly 28 are positioned in quadrants 2 and 4. The pistons' placement provide engine balance and a fly wheel effect.

Each of the chamber inner end plates 23 and 24 have opposing curvilinear exhaust or vent apertures 32 therethrough. Each chamber end plate further includes two valve receiving apertures 34 spaced 180 degrees apart. The valve receiving apertures of the chamber end plates are longitudinally aligned.

A pair of valve assemblies 36 (one shown) which includes a valve member 38 (one shown) shuttles or translates between the chambers. Two sets of fluid channels 40 positioned 180 degrees apart are centrally positioned in the inner annular wall surface of each chamber (see FIGS. 5, 6, 11 and 14.)

Figure 9:
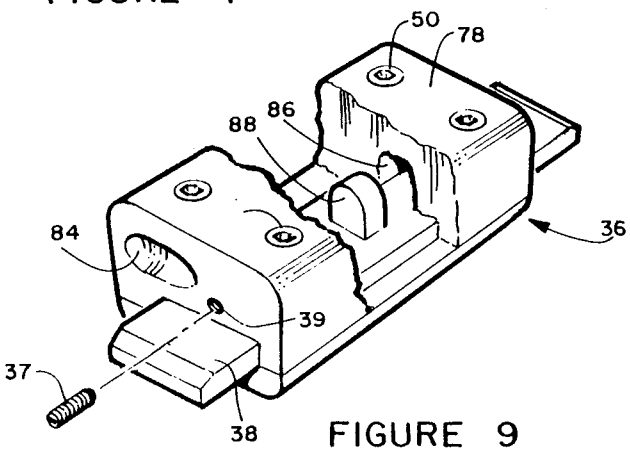
FIG. 9 is a perspective showing of the shuttle valve shown in FIG. 1.

The fluid channels 40 align with a channel 42 in the top and bottom surfaces (see the various Figures) which connects the ends of the fluid channels as a continuation of the channel 40 and a chamber transverse bore 44 (See FIGS. 5, 6, 11 and 14 adjacent to an opening in the valve assembly) which channel the fluid to an opening 84 in the valve assembly (see FIG. 9). These channels and bores 40 and 44 respectfully direct the fluid into a valve chamber the operation of which is hereinafter described.

Mechanical spacers 46 are positioned adjacent to each corner of the chamber end plates 23 and 24 remote from the valve assemblies for locating the annular chambers 20 and 22 in a proper relative position and maintaining that position. The spacers are fixed in position by cap screws 48.

Fastening means 50 are used to connect the various elements together. Screws are shown but it should be understood that any suitable fastening means can be employed to practice the invention.

A screen panel 52 (also see FIG. 3) is positioned vertically intermediate the inner chamber end plates 23 and 24 the purpose of which will be hereinafter explained.

The input connection 54 for the working fluid under pressure is shown as a threaded attachment, however, it should be understood that any suitable connection means can be employed to practice the invention, for example a quick disconnect type connection would be suitable for this purpose.

The only requirement of the materials of construction of the various elements of the invention is that they be chosen to best suit the purpose for which the invention is intended.

Figures 2, 3, 4, 5, 6:
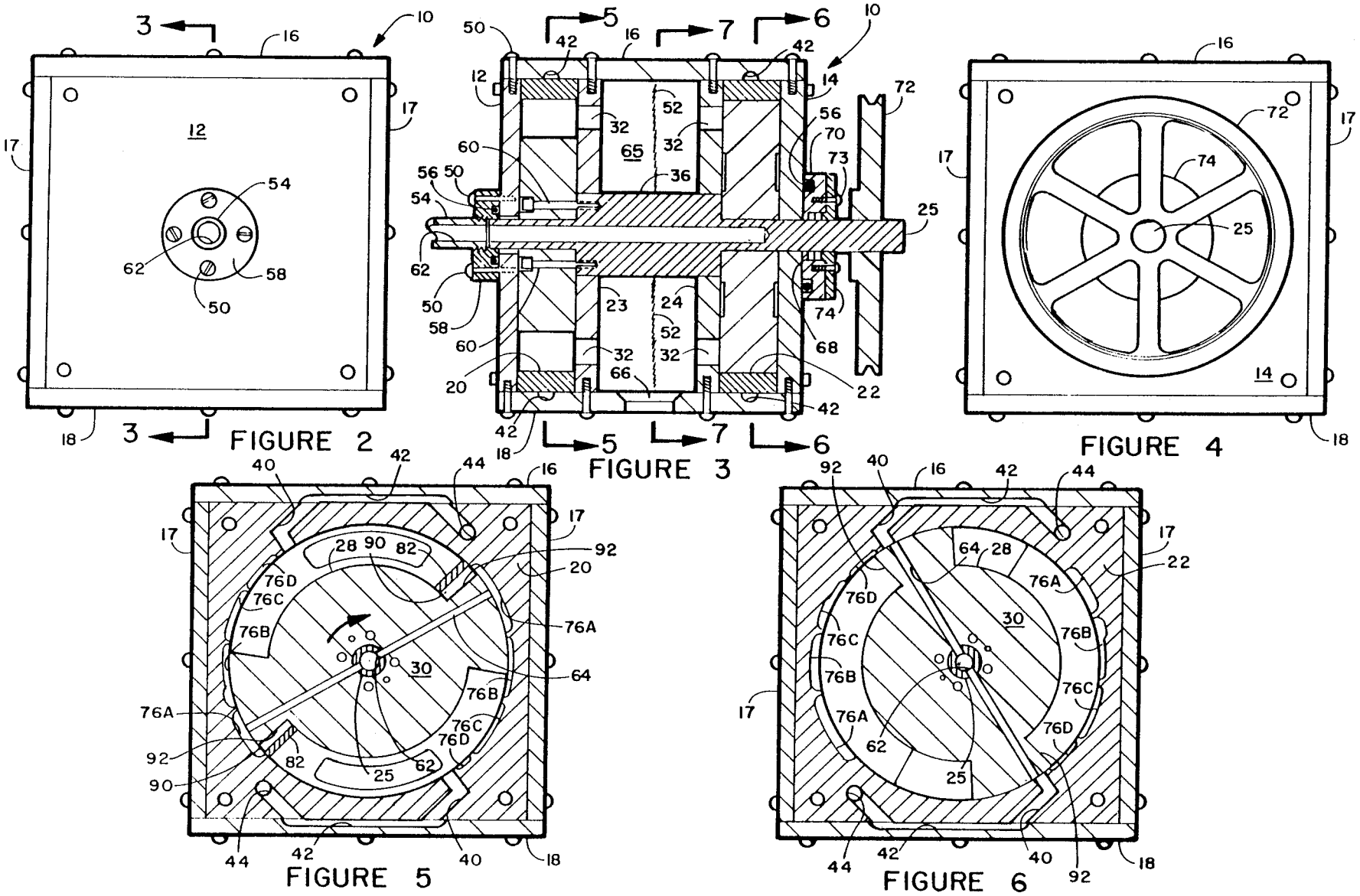
FIG. 2 is an end view showing of FIG. 1 depicting the working fluid input connection to the engine.
FIG. 3 is a showing taken along line 3—3 of FIG. 2.
FIG. 4 is a showing of the end of the external combustion engine of FIG. 1 opposite from the FIG. 2 showing depicting a power output pulley.
FIG. 5 is a showing taken along line 5—5 of FIG. 3.
FIG. 6 is a showing taken along line 6—6 of FIG. 3.

Referring now to FIG. 2, which depicts the working fluid input end plate 12 of the engine 10 of the invention. The relationship of the top 16, bottom 18, side walls 17 and input end plates 12 are shown.

Referring now to FIG. 3, this Figure depicts a section taken along the longitudinal center line of the engine of the invention with the valve assemblies 36 removed. In addition to the elements described above, additional elements are shown. An "O" ring seal 56 is positioned between the input end plate 12 and the working fluid input flange 58. Typically cap screws 60 are used for fixedly attaching the piston assemblies to the shaft. The channel formed by the hollow portion 62 of the shaft is shown terminating slightly past the vertical center of the piston on the right side of the Figure. A bore 64 (see FIGS. 1, 5, and 6) through the piston assembly 28 communicates with the hollow portion of the shaft providing a working fluid path from the source of the fluid to the outer surface of each piston of each piston assembly. Spent working fluid passes through exhaust manifold 65 to a fluid drain opening 66 located in the housing bottom 18. The opening 66 returns the spent working fluid to a collection sump (not shown) for reuse.

Referring now to FIG. 4, an end view showing of the engine 10 of the invention depicts the power output or working end of the engine. A compression or carbon seal 68 (also see FIG. 3) is shown positioned between an output end flange 70 and a shaft 25. The seal remains stationary relative to the rotation of the shaft 25. Screws 73 hold the compression seal in place and provide wear adjustment compensation by seal compression. A second "O" ring seal 56 is positioned between the output end plate 14 and the flange 70.

Referring now to FIG. 5, the annular chamber 20 and piston assembly 30 of the left side of FIG. 1 is shown. As can be seen in this Figure, the bore or channel 64 through the piston assembly from the shaft's central hollow portion is aligned with a trough 76A on each side of the chamber. It should be noted that it is shown in the various Figures that the area of the troughs 76A–76D reduce in size in a clockwise direction and that the troughs on opposite sides of each chamber start and end 180 degrees apart.

Referring now to FIG. 6, the chamber 24 and piston assembly 30 of the right side of FIG. 1 as shown. Note that the piston assembly is rotated 90 degrees from the piston assembly 30 of the left piston assembly shown in FIG. 5. Relative piston displacement is fixed relative to the shaft as herein before mentioned.

Figure 7:
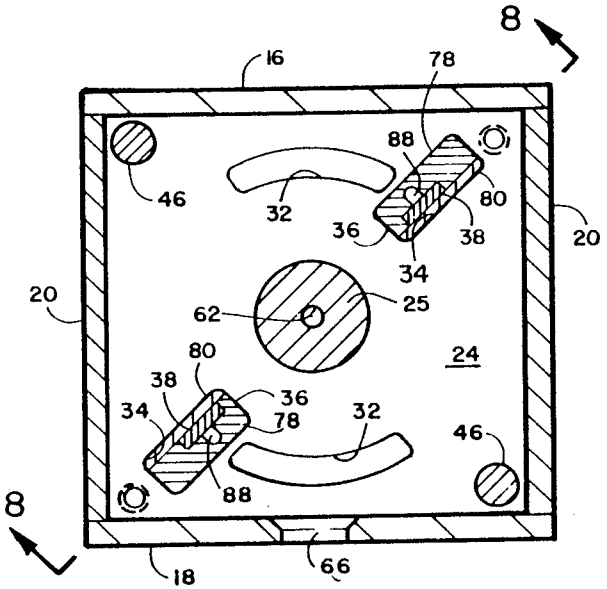
FIG. 7 is a showing taken along line 7—7 of FIG. 3.

FIG. 7 is a view taken along line 7—7 of FIG. 3 clearly showing the curvilinear exhaust ports 32, the valve assembly 36 which includes a stator 78 fixedly attached between the chamber end plates 23 and 24 in grooves 80 and held in place thereby.

Figure 8:
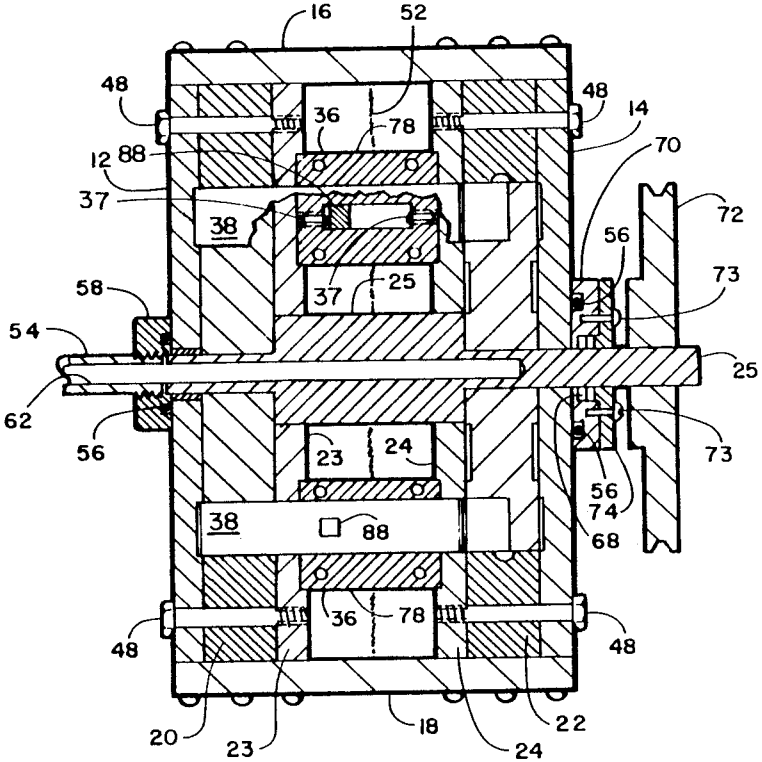
FIG. 8 is a showing taken along line 8—8 of FIG. 7.

FIG. 8 is a showing taken along line 8—8 of FIG. 7 showing the translating shuttle valve 38 of each valve assembly 36 translated to the left hand side of the Figure. This allows the pistons of the piston assembly at the right of the Figure to rotate past the valve assemblies.

FIG. 9 is a perspective cutaway showing of the shuttle valve assembly 36 including stator 78 and the translating shuttle valve 38. The stator 78 includes a bore 84 on each side thereof which extends into a valve chamber 86 which houses a shuttle valve piston 88. A stop adjustment screw 37 is threaded into an aperture 39 leading into valve chamber 86 to the extent that the travel of shuttle valve piston 88 is controlled to prevent the end of shuttle valve 38 so that it does not bang into the side walls of the cylinders when translated.

FIGS. 10 through 15 show the positional and size relationship of the troughs 76A–76D of each chamber.

DETAILED EXPLANATION OF THE OPERATION OF THE PREFERRED EMBODIMENT

Steam or other working fluid under pressure of about 80 PSI or greater enters the engine through the inlet flange 58 attached to the fluid input end plate 12 of the engine housing via input connection 54. The fluid travels down the hollow portion 62 of the shaft 25 and into the bores or channels 64 in each of the piston assemblies. The bores or channels 64 in each piston assembly terminate at the outer central surface of each piston at a port 40 adjacent to the central surface of the annular chamber wall. The flow of fluid is blocked except when a port 40 is positioned adjacent to a trough 76A–76D cut into the annular chamber walls or adjacent to fluid channels 40 leading to valve assemblies 36 for translating or shuttling the valve member 38 to the opposite chamber. As aforementioned, the piston assemblies are attached to the rotor shaft 25 at right angles to each other and extend to the troughs and various passages or channels. This arrangement results in the fluid entering only one annular chamber at a time and provides fluid simultaneously to both pistons of the same piston assembly.

For the purpose of discussing the operation of the engine 10 of the invention, the shuttle valve member 38 of the slide valve assembly 36 is initially positioned to block the annular chamber as shown on the left side of drawing FIGS. 3 and 8, i.e. the pistons in the annular chamber as shown on the right of the drawings is free to rotate past the valve assembly. The pistons of the rotor assembly of the left side of the engine are immediately in front of the valve shuttle and the opening from the bore or channel through the piston assembly located at the outer surface of each piston of the piston assembly in line with troughs 76A. The leading edge projection of the pistons block the forward end of the of the fluid troughs 76A so that the fluid must flow into location 90 defined by the shuttle valve 38, the working surface of the pistons, piston assembly and annular chamber walls. The pressure of the working fluid in location 90 of the chamber moves the only movable surface, namely, the piston assembly in a clockwise direction. As aforementioned the troughs 76A–76D cut into the central annular portion of the chambers began at the same location relative to the piston positions but are of different cross-sectional areas. This feature assures that working fluid under pressure is entering either one chamber or the other at any rotational position of the piston assemblies. However, the quantity of fluid entering each chamber is decreasing rapidly. As the piston rotates, the spent working fluid from the prior cycle remaining in the chamber is forced out of the exhaust vents 32, by the leading edge projection of the piston into the exhaust manifold 65 and out sump passage 66. At the same time the piston faces or working surfaces 92 of the pistons of the right piston assembly are passing the exhaust vents 32 in the right chamber resulting in a free flow of spent working fluid in the right annular chamber. The fluid in the exhaust chamber, when in a liquid form, partially collects on the center screen 52 and travels down the screen through the opening 66 to the sump by gravity.

As the left piston assembly rotates to a position near the end of a quadrant, the piston end of the bore or channel 64 begins to align with the chamber end of the bore 40 in the central annular chamber wall which allows the working fluid under pressure to exit the transverse bore 44 and enter on the left side of the slide valve into opening 84. The slide valve cannot translate to the right chamber because of the presence of pistons of the right piston assembly in front of the shuttle valve member 38. As the openings of the bores 64 of the left pistons overlap the openings to channels 40 in the annular chamber wall by substantially one half, the working surfaces of the pistons in the right chamber clear the slide valve opening and the working fluid under pressure in the slide valve chamber 86 forces the slide valve piston 88 and the slide valves to translate into the right chamber rapidly. As the assemblies continue to rotate in a clockwise direction, continuing pressure is maintained in channel 42 by the left piston assembly holding the valve shuttles in the right chamber while pressure is increasing in the right chamber as the working fluid under pressure enters the chamber via troughs 76A–76D as the above described cycle is repeated.

It should be readily apparent from the above operational discussion that there are short power impulses provided by each trough (four shown) or a total of sixteen in the embodiment shown for each revolution of each piston assembly. With working fluid having a sufficient pressure for intended operation, and the two piston assemblies as shown, the four pistons provide a considerable amount of rotational torque.

When the engine of the invention is operated with high temperature steam as the working fluid, the feature of screen 52 is important in directing the condensate produced from the spent steam to a holding reservoir for reuse rather than allowing condensate to enter into the opposite exhaust vent opening. The entire engine and sump (not shown) are insulated with suitable insulation material to maintain the condensate at an elevated temperature to reduce the energy required to change the water back to steam.

It should be understood that similar pairs of additional piston assemblies could be similarly attached to an extended rotor shaft 36 for practicing the invention if additional power output were required.

While a preferred embodiment of the invention has been shown and described, it will be apparent to those skilled in the art that changes can be made in this embodiment without departing from the principles and spirit of the invention, the scope of which is defined in the appended claims.

What is claimed is:

1. A rotary external combustion engine comprising:

at least one pair of side by side vertically displaced annular chambers;

a pair, of piston assemblies, one positioned in each of said annular chambers, each of said piston assemblies comprising a pair of pistons each of said pistons having a working surface positioned 180 degrees apart, said pistons conform to said annular chambers and rotate relative thereto;

a shaft extending through said cylinders, the central portion of said shaft is tubular along a portion of its length, said pistons assemblies are fixedly connected to said shaft with the pistons of one of said piston assemblies being displaced 90 degrees from the pistons of the other piston assembly;

a plurality of discrete troughs positioned circumferentially on the inner central wall of said annular chamber remote from the horizontal center line thereof at two locations in each of said annular chambers, said two locations being substantially 180 degrees apart, each of said discrete troughs at each of said locations are of a different cross sectional area and the leading edges of the first trough encountered by both pistons of each piston assembly and the trailing edges of the last of said plurality of discrete troughs are substantially 180 degrees apart;

a source of working fluid under pressure, said source of said working fluid under pressure communicating with the open distal end of the hollow portion of said shaft;

passage means for directing said working fluid under pressure from said hollow portion to the outer central portion of each of said pistons of said piston assemblies at a discrete location in circumferential alignment with said discrete troughs;

a pair of translatable shuttle valves for simultaneous translation between a position blocking one annular chamber to a position blocking the other annular chamber, and control means of each of said shuttle valves being interconnected to said working fluid under pressure from the discrete location on said pistons when said pistons of one of said annular chambers are at a specific rotational location whereby said working fluid causes said pair of shuttle valves blocking that annular chamber to translate to a position blocking the other annular chamber;

an opening in each of said annular chambers in two locations substantially 180 degrees apart for exhausting spent working fluid from said annular chambers when said shuttle valves are translated from an annular chamber; and an output power connection means positioned on the end of said shaft remote from hollow distal end.

2. The invention as defined in claim 1 wherein a top, a bottom and side walls enclose said pair of annular chambers forming a unitary structure.

3. The invention as defined in claim 2 wherein an opening is provided in the bottom wall surface between the adjacent walls of said annular chambers.

4. The invention as defined in claim 3 wherein a thin sheet of material is positioned vertically between said adjacent walls of said chambers over said opening in said bottom surface.

5. The invention as defined in claim 1 wherein said pistons taper longitudinally toward their leading edges forming cam surfaces thereby.

6. The invention as defined in claim 5 wherein only the side of said piston adjacent to the opening in said annular chambers are tapered.

7. The invention as defined in claim 6 wherein said taper of said piston is substantially 30 degrees.

8. The invention as defined in claim 1 wherein said pistons include a body surface adjacent to said inner central wall forward of said working surfaces for blocking off said discrete troughs forward of said passage means.

9. The invention as defined in claim 1 wherein the working fluid under pressure is steam.

10. The invention as defined in claim 1 wherein the total distance covered by said plurality of discrete troughs at each location is substantially equal.

11. The invention as defined in claim 1 wherein said working fluid under pressure has a pressure of at least 80 PSI.

12. The invention as defined in claim 1 wherein each of said shuttle valves has a centrally positioned piston which encounters said working fluid for translation of said shuttle valves from one chamber to the other.

* * * * *